United States Patent [19]

Andreasen

[11] Patent Number: 4,881,503

[45] Date of Patent: Nov. 21, 1989

[54] THROTTLE CABLE CONTROL ASSEMBLY FOR CARBURETORS

[76] Inventor: Norman H. Andreasen, 1522 Norwood Ave., Itasca, Ill. 60143

[21] Appl. No.: 350,241

[22] Filed: May 11, 1989

[51] Int. Cl.[4] ..... F02D 11/04

[52] U.S. Cl. ..... 123/400; 74/513; 251/279

[58] Field of Search ..... 123/400, 403, 583; 261/65; 74/513; 251/279

[56] References Cited

U.S. PATENT DOCUMENTS 2,866,446 12/1958 Euerstein et al. ..... 123/400

3,543,601 12/1970 Berger ..... 123/400

FOREIGN PATENT DOCUMENTS 1092118 1/1954 France ..... 251/279

*Primary Examiner*—Tony M. Argenbright

*Assistant Examiner*—Robert E. Mates

*Attorney, Agent, or Firm*—Edward D. Gilhooly

[57] ABSTRACT

Throttle cable control assemblies for carburetors for adjustably mounting the throttle (accelerator) cable on the carburetor. A bracket body is mounted on the carburetor and includes a projecting arm having a post. A clamp assembly frictionally engages the post and throttle cable. The clamp assembly is capable of being pivoted on and movable along the post for adjustment.

11 Claims, 3 Drawing Sheets

THROTTLE CABLE CONTROL ASSEMBLY FOR CARBURETORS

BACKGROUND OF THE INVENTION

1. Field of the Invention

This invention relates in general to carburetors for engines, and more particularly, to a throttle (accelerator) cable control assembly for carburetors.

2. Description of the Prior Art

A carburetor is a long used component for internal combustion engines. The carburetor simply acts to vaporize fuel into combustion air prior to combustion in the engine. The adjustment of the air-fuel ratio in a carburetor for various power needs is effected by means of a valve generally controlled by a throttle or accelerator cable. In a vehicle the throttle cable usually extends from the carburetor to an accessible position for control by the operator. The throttle cable is controlled by a foot pedal, throttle, speed governor and the like. Even in the current widespread use of fuel injection systems. carburetors are still widely used with engines, whether fueled by gasoline or propane, in a widespread number of automobiles, trucks, fork lifts and the like.

Despite its long use, current techniques for mounting and holding a carburetor operating cable presents several disavantages. Known assemblies for mounting and securing cables cause problems in receiving, aligning, and adjusting the throttle cable fo optimum performance. The shortcomings of known attachment devices for throttle cables are evident both during the manufacture of the vehicle during hook-up, and during or after subsequent adjustment, repair, and/or replacement of the carburetor. Consequently, a need exists for improvements in the techniques and devices by which the throttle (accelerator) cables used with carburetors are retained and mounted.

SUMMARY OF THE INVENTION

It is therefore an objective of the invention to provide improved assemblies for effectively and conveniently mounting a throttle (accelerator) cable to a carburetor and retaining it during operation of the vehicle and the like. The invention is provided with a bracket body capable of supporting clamp assembly means which provide for adjustable attachment of the cable to the carburetor. The clamp assembly means receives and holds the throttle cable shroud ferrule, enabling alignment and lineral adjustment on a retention post. The clamp assembly means may be easily raised or lowered on the support post in order that the correct lineal position may be determined. The lineal adjustment provided by the the invention compensates for variation in the length of the cable operating within the cable shroud ferrule. The clamp assembly means herein disclosed also permit a simple rotational manipulation for alignment with the throttle shaft lever. A single manual setting of the cable is possible using conventional mechanic tools, facilitating alignment and lineal adjustment. The several embodiments of the invention permit alternative mounting positions on the carburetor for retaining and holding the throttle cable.

DESCRIPTION OF THE PREFERRED EMBODIMENTS

Figure 1:
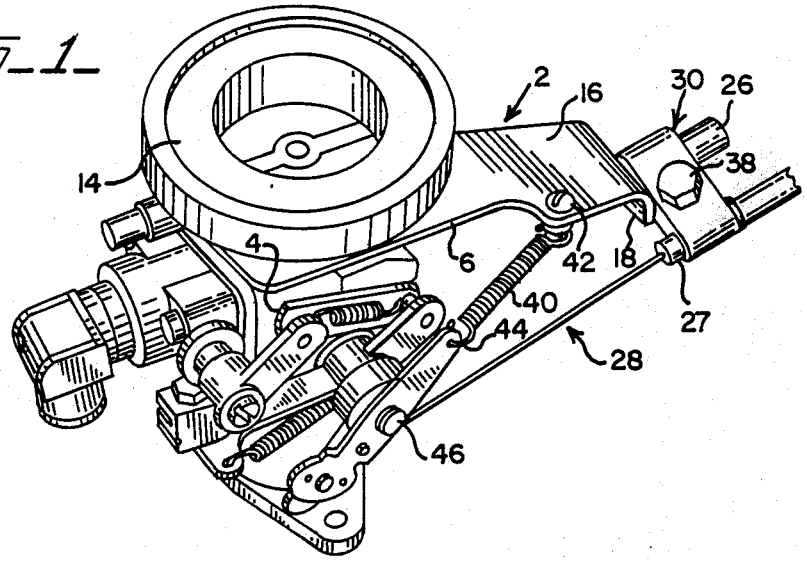
FIG. 1 is a side perspective view of a vehicle carburetor having a first embodiment of the throttle cable control assembly of the invention mounted thereon.

Referring now to FIGS. 1–4 there is illustrated a first embodiment of the throttle cable control assembly of the invention, generally designated by reference numeral 2. The throttle cable control assembly 2 is intended to mount the throttle or accelerator cable (not shown) so that a carburetor may controlled from a remote positon by an operator. Although the invention may be used with numerous designs of carburetors, whether with gasoline or propane, on any type of powerplant, the carburetor device 4 is shown as a OHG model X-100 carburetor 4 used on various forklift trucks. The throttle cable control assembly 2 includes a bracket body 6 stamped from a metal in a generally flat, one-piece configuration. The base 8 of bracket body 6 is formed an approximate rectangular shape with a central opening 10 and a plurality of holes 12, four of which are shown, for receiving threaded screws (not shown) for attachment to the carburetor 4. The base 8 is mounted beneath the air cleaner device 14 on to the air cleaner adapter provided on the carburetor 4. The screws (not shown) extend through the holes and corresponding holes provided in the air cleaner adapter. The air cleaner adapter 14 is placed over the base 8 and is affixed to the carburetor 4 in a standard manner. It should be apparent that opening 10 permits the passage of air from the air cleaner 14 into the carburetor 4.

Figure 2:
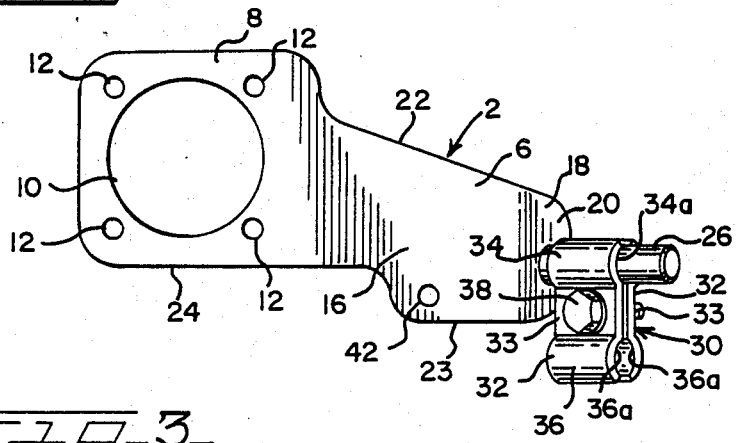
FIG. 2 is a top plan view of the bracket body and clamping assembly of the throttle cable control assembly of FIG. 1.
Figure 3:
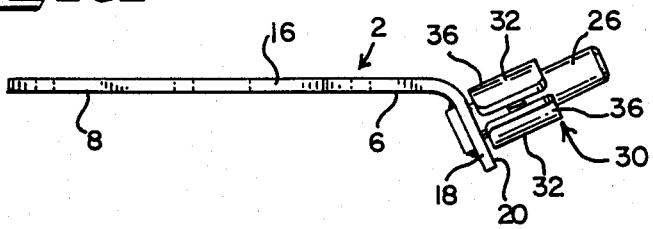
FIG. 3 is a side elevational view of the bracket body and clamping assembly of the throttle cable control assembly of FIG. 2.
Figure 4:
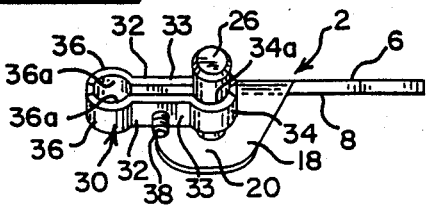
FIG. 4 is an end elevational view of the bracket body and clamping assembly of the throttle cable control assembly of FIG. 2.
Figure 5:
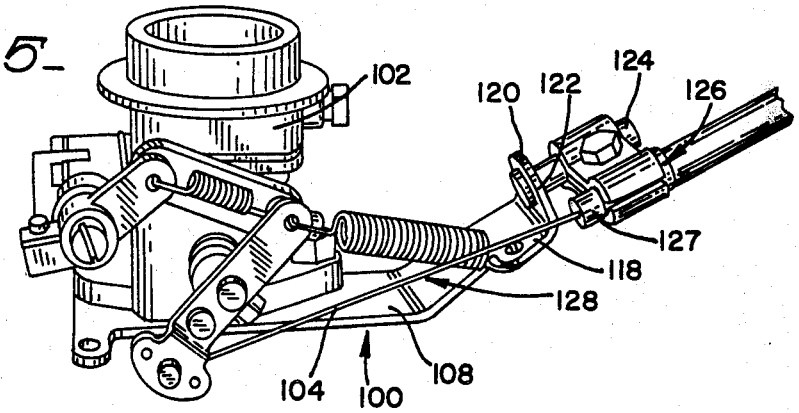
FIG. 5 is a side perspective view of a vehicle carburetor having a second embodiment of the throttle cable control assembly of the invention mounted thereon.
Figure 6:
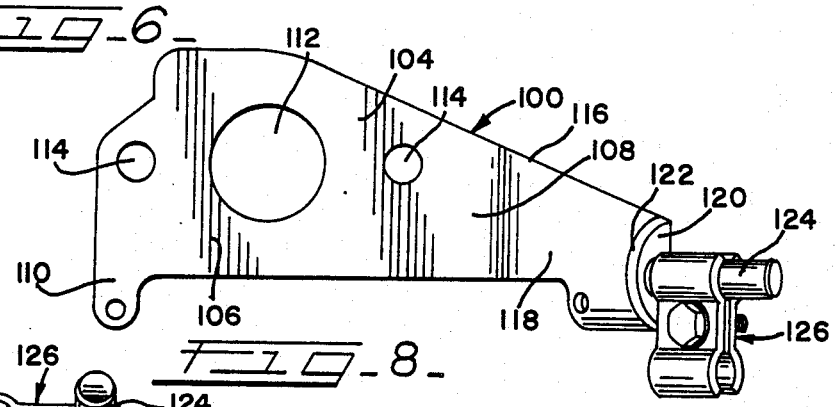
FIG. 6 is a top plan view of the bracket body and clamping assembly of the throttle cable control assembly of FIG. 5.
Figure 8:
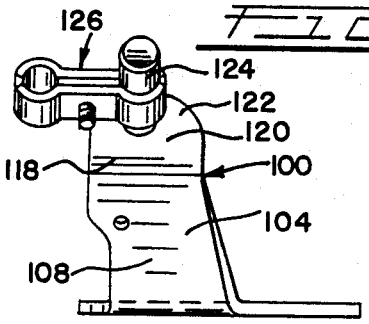
FIG. 8 is an end elevational view of the bracket body and clamping assembly of the throttle cable control assembly of FIG. 5.
Figure 7:
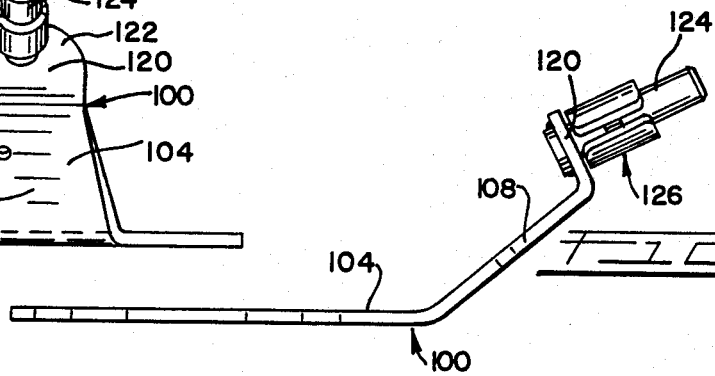
FIG. 7 is a side elevational view of the bracket body and clamping assembly of the throttle cable control assembly of FIG. 5.

The bracket body 6 includes a flat arm 16 integrally extending outward from base 8. The arm 16 terminates with a flat bent down edge portion 18 forming a flange surface 20. One outwardly extending edge 22 of arm 16 is sloped while the opposite edge 23 is offset in spaced relationship to the axis of edge 24 of base 8 (FIG. 2). A post 26 is affixed to edge portion 18 and extends outward from flange surface 20. The post 26 can be mounted in a hole in edge portion 18 and may be suitably affixed thereto, such as by welding. A clamp assembly 30 is supported on post 26 and acts to retain the throttle (accelerator) cable assembly 28 to the carburetor 4. As best seen in FIGS. 2–4, the clamp assembly 30 includes two matching clamping plates 32. The clamping plates 32 each have a flat central areas 33 and opposed curved sections 34 and 36 respectively to embrace the post 26 and the ferrule 27 of a throttle cable assembly 28. The internal surfaces 34*a* and 36*a* have a modified wedge-like shape for suitable frictional engagement of the post 26 and ferrule of the cable in the secured state. The respective ends of curved sections 34 and 36 of the matching clamping plates 32 are spaced from each other to permit a clamping movement during installation. A threaded member 38 extends through the intermediate areas 33 of clamping plates 32 so that the clamping plates 32 can be clamped simultaneously against the post 26 and the throttle cable ferrule.

In a relatively loosen state, the clamp assembly 30 can be pivoted relative to the post 26 for effective alignment of the the cable to be attached. The clamp assembly 30 can also be moved lengthwise along post 26 prior to tightening of the threaded member 38 to fine tune the length of the throttle cable assembly for compensation of any variations. After the the throttle cable assembly is positioned between curved sections 36 and the clamp assembly 30 has been adjusted on post 26, the threaded member 38 is tightened to frictionally affixed the clamp assembly 30 to both the post 26 and the throttle cable assembly for a secure, heavy-duty mounting. As further seen in FIGS. 1 and 2, the off-set design of the arm 16 at edge 22 permits a spring 40 to be affixed to hole 42 in arm 16 by any suitable technique. The opposite end 44 of spring 40 is attached to the throttle operating lever assembly 46, which returns the carburetor 4 throttle shaft to an idle position.

Referring now to FIGS. 5–8, there is illustrated another embodiment of the throttle cable control assembly of the invention, generally designated by reference numeral 100. The throttle cable control assembly 100 is located under the carburetor 102 and includes a bracket body 104. The bracket body 104 is formed in a modified shape as compared to the bracket body 6 of the preceding embodiment. The bracket body 104 possesses a flat base 106 and an outward extending arm 108. A second smaller arm 110 integrally projects from base 106 on the opposite side of base 106 than arm 108. A central opening 112 and a pair of attachment holes 114 are provided on base 106. The base 106 is arranged to be mounted beneath the carburetor 102 on the carburetor adapter bracket (not shown) provided on the engine of the vehicle and the like. The opening 112 corresponds to the intake provided in the carburetor adapter bracket into the engine.

The arm 108 includes a tapered edge 116 (FIG. 6) and terminates with an upper bent portion 118. A flange 120 further angularly extends from the bent portion 118 at approximately 90 degrees and includes an edge 122 having a semi-circular shape. A post 124 and clamp assembly 126 are mounted on flange 120 and are of the identical construction and perform the same function as post 26 and clamp assemly 30 of the preceding embodiment to clamp the ferrule 127 of the throttle cable assembly.

Referring now to FIGS. 9–12, there is illustrated still another embodiment of the throttle cable control assembly of the invention, generally designated by reference numeral 150. The throttle cable control assembly 150 includes a generally flat bracket body 152 formed with a base 154 and a pair of opposed projecting arms 156 and 158 (FIG. 2). The base 154 includes a an approximate rectangular configuration having a central opening 160 and four attachment holes 162. The base 154 is positioned on carburetor 164 between the top of the carburetor and the bottom of the air cleaner adapter 166 with screws (not shown) extending through holes 162 into the carburetor body.

Figure 9:
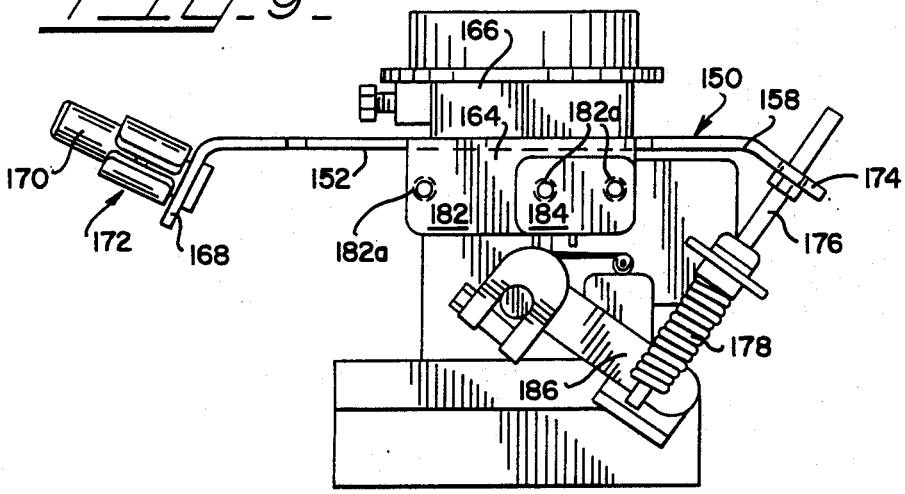
FIG. 9 is a side elevational view of a carburetor having a third embodiment of the throttle cable control assembly of the invention mounted thereon.
Figure 10:
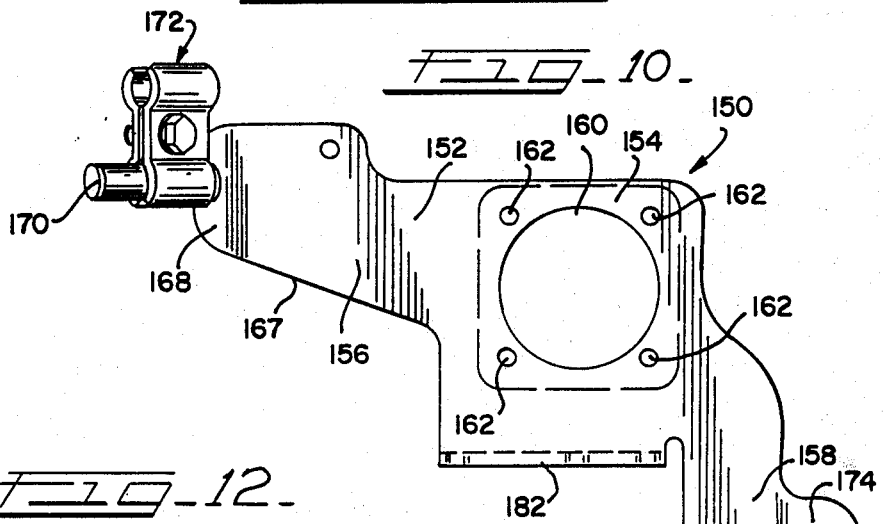
FIG. 10 is a top plan view of the bracket body and clamping assembly of the throttle cable control assembly of FIG. 9.
Figure 12:
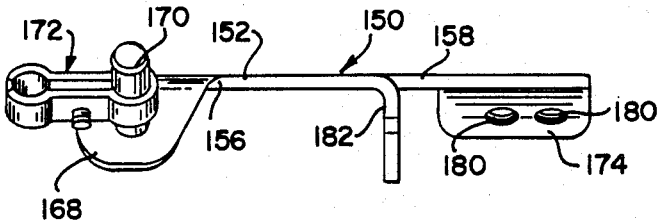
FIG. 12 is an end elevational view of the bracket body and clamping assembly of the throttle cable control assembly of FIG. 9.
Figure 11:
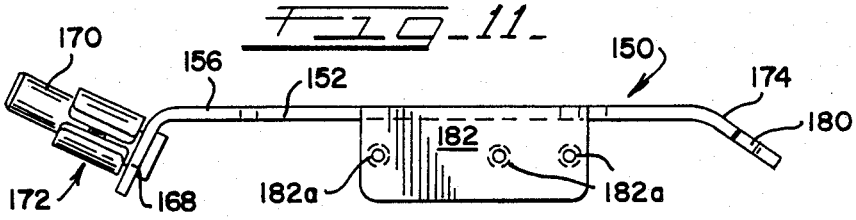
FIG. 11 is a side elevational view of the bracket body and clamping assembly of the throttle cable control assembly of FIG. 9.

The arm 156 includes a tapered edge 167 and terminates with an angled flange 168 provided on its free end, A post 170 and clamp assembly 172 are mounted on flange 162 and are of an identical design as the post and clamp assembly previously described with reference to the preceding embodiments. The second arm 158 projects from base 154 in a direction generally at right anles to the projecting axis of arm 156. The free end portion 174 of arm 158 is bent downward to mount the threaded extension arm 176 of a conventional dash pot or idle cushion device 178 for sensing engine vacuum drop in a selected one of the two threaded holes 180 formed on end portion 174 (FIG. 9). A mounting plate 182 is integrally formed downward from base 154 and includes holes 182*a* to mount a vacuum advance switch 184 of known design for electronically maintaining engine speed, which cooperates with lever assembly 186 of the dash pot 178 in well known manner.

Figure 13:
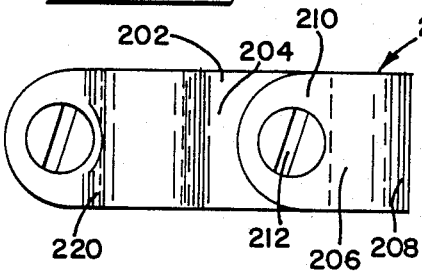
FIG. 13 is a top plan view of a modified clamp assembly for use in the throttle cable control assembly of the invention.
Figure 14:
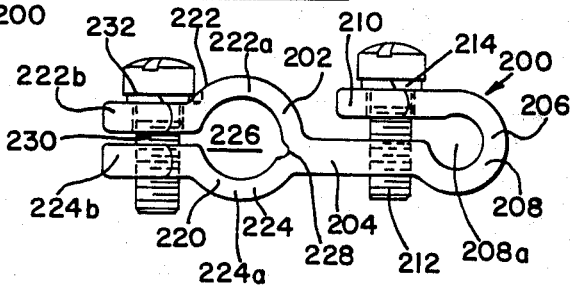
FIG. 14 is a side elevational view of the modified clamp assembly of FIG. 13.

Referring now to FIGS. 13 and 14, there is illustatrated a modified version of the clamp assembly, designated by reference numeral 200. The clamp assembly 200 may use in place of clamp assembly 30, 126, and 172 of the preceding embodiments of the throttle cable control assemblies of the invention described with reference to FIGS. 1–12. Clamp assembly 200 is formed as an one-piece body 202 that can be suitably cast from a metal. The body 202 possesses a flat base 204 and an integrally forxed cable clamp 206. The cable clamp 206 extends as an approximate semi-circular section 208 defining an opening 208*a* through which the throttle (accelerator) assembly (not shown) extends. The semi-circular section 208 has a flat free end portion 210 that confronts the base 204 in spaced relationship. A threaded member 212 and lock washer 214 is disposed through holes in base 204 and end portion 210. As seen in FIG. 14, the thickness of the semi-circular portion of cable clamp 206 is less than the thickness of base 204 to allow flexing of the cable clamp 206 and frictional engagement with throttle cable assembly upon tightening.

A post clamp 220 projects from the opposite side of base 204 and has a modified split ring configuration formed by upper and lower clamping plates 222 and 224 that define a post opening 226. The upper and lower clamping plates 222 and 224 are mirror images of each other and include a curved intermediate section 222*a* and 224*a* and flat free end portion 222*b* and 224*b*. The end portions 222*b* and 224*b* lie in parallel confronting relationship to each other. A notch 228 is formed on an edge of base 204 to provide rigid flexing of the upper and lower clamping plates 222 and 224. A threaded member 230 and lock washer 232 permit the post clamp 220 to be loosen and tightened for securement on the post of the throttle cable control assemblies of the previous embodiments. Thus, in the embodiment of FIG. 13 and 14, two threaded members are used to engaged the throttle cable assembly and make the previously described adjustments on the post and subsequent securement.

In the preceding embodiments, it is within the scope of the invention to form any of the posts 26, 124, nnd 170 with a serrated or knurled surface (not shown) for better frictional retention of the clamp assemblies.

What is claimed is:

1. A throttle cable control assembly for carburetors comprising a bracket body for attachment to the carburetor, said bracket body having a base for mounting on the carburetor and at least one arm extending outward from said base, said at least one arm includes a free end portion, a post mounted on said free end portion of said base, and clamp means being adjustably clamped to said post and to the throttle cable for the carburetor.

2. The throttle cable control assembly according to claim 1 wherein said clamp means includes attachment means for selectively permitting movement of said clamp means on said post and for clamping said clamp means on said post.

3. The throttle cable control assembly according to claim 2 wherein said clamp means is moveable lengthwise and pivotally relative to said post.

4. The throttle cable control assembly according to claim 3 wherein said clamp means includes a pair of clamping plates, said clamping plates having a first pair of clamping surfaces to frictionally engage said post and second pair of clamping surfaces to frictional engage the throttle cable.

5. The throttle cable control assembly according to claim 4 wherein said said attachment is a threaded member, said member causing said first and second pair of clamping surfaces to simultaneously engage said post and said throttle cable.

6. The throttle cable control assembly according to claim 3 wherein said clamping means includes a body having a first clamping portion for engaging said post and a second clamping portion for engaging the throttle cable.

7. The throttle cable control assembly according to claim 6 wherein said first clamping portion includes an internal surface arranged to surround a portion of said post, said second clamping portion includes an internal surface for surrounding a portion of the throttle cable.

8. The throttle cable control assembly according to claim 7 wherein said attachment means includes a first and second threaded member, said first threaded member being operative attached to said first clamping portion to cause said first clamping surface to engage said post, said second threaded member to cause said second clamping surface to engage the throttle cable.

9. The throttle cable control assembly according to claim 7 wherein said first clamping portion includes a curved section for engaging said post, said second clamping portion is a pair of clamping plates arranged to be urged by said attachment means against the throttle cable.

10. The throttle cable control assembly according to claim 1 further comprising a second arm extending from said base, said second arm having an end portion for a carburetor dash pot.

11. The throttle cable control assembly according to claim 10 further comprising a plate integrally disposed on said base, said plate adapted to mount a carburetor switch mechanism.

* * * * *